252-104 AU 165 EX
11/8/77 XR 4,057,505

United States Patent [19]
Nakagawa et al.
[11] 4,057,505
[45] Nov. 8, 1977

[54] LIQUID CLEANING AND BLEACHING COMPOSITION

[75] Inventors: Yunosuke Nakagawa, Koshigaya; Kanji Majima; Sigeyuki Miyamoto, both of Wakayama, all of Japan

[73] Assignee: Kao Soap Co., Ltd., Tokyo, Japan

[21] Appl. No.: 702,404

[22] Filed: July 6, 1976

[30] Foreign Application Priority Data

July 14, 1975 Japan ..... 50-85961

[51] Int. Cl.² ..... C11D 9/42

[52] U.S. Cl. ..... 252/96; 252/95; 252/99; 252/103; 252/104; 252/531; 252/532; 252/550

[58] Field of Search ..... 252/94, 85, 96, 99, 252/103, 104, 531, 532, 550

[56] References Cited

U.S. PATENT DOCUMENTS 3,480,556 11/1969 Dewitt et al. ..... 252/550 X
3,728,266 4/1973 Komeda et al. ..... 252/98
3,929,661 12/1975 Nakagawa et al. ..... 252/103

*Primary Examiner*—Mayer Weinblatt
*Attorney, Agent, or Firm*—Blanchard, Flynn, Thiel, Boutell & Tanis

[57] ABSTRACT

A liquid cleaning and bleaching composition containing from 3 to 7% by weight of an alkali metal hypochlorite and from 0.5 to 8% by weight of a surface active agent having the formula $$R_1-\underset{\underset{CH_2OSO_3M}{|}}{CH}-R_2$$

wherein $R_1$ and $R_2$ are alkyls having from 1 to 13 carbon atoms with the proviso that the total number of the carbon atoms of $R_1$ and $R_2$ is from 8 to 14; and M is Li, Na or K.

11 Claims, No Drawings

LIQUID CLEANING AND BLEACHING COMPOSITION

BACKGROUND OF THE INVENTION

1. FIELD OF THE INVENTION

This invention relates to a stable liquid cleaning and bleaching composition comprising a surface active agent having a high biodegradability and an alkali metal hypochlorite.

2. DESCRIPTION OF THE PRIOR ART

Aqueous solutions of sodium hypochlorite are widely used for purposes of bleaching, disinfection, deodorization and the like. When such a solution is used especially for bleaching, in combination with a surface active agent, the bleaching effect is further enhanced by the permeating action and cleaning action owing to the presence of the surface active agent. This method is employed in the textile fiber industry. Likewise sodium hypochlorite-type bleaching agents are used simultaneously with washing detergents for general home laundry use. It would therefore be convenient if a surface active agent could be added to an aqueous solution of sodium hypochlorite in advance.

An aqueous solution of sodium hypochlorite, however, is a solution of a strong alkaline oxidizing agent and at the same time, it is an aqueous solution of an inorganic salt. For these reasons, decomposition of the surface active agent takes place (which results in further decomposition of the sodium hypochlorite), or the surface active agent is salted out, thereby inhibiting dissolution thereof in a large amount. These and other related problems are not yet solved in a completely satisfactory manner.

Various studies have been conducted to develop a surface active agent which can be added to aqueous sodium hypochlorite solutions to form a stable composition. The following are typical of such prior art attempts.

As the surface active agent for this purpose, Japanese Patent Publication No. 6268-63 discloses alkyldiphenylether sulfonate having the following formula (A)

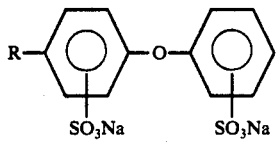

(A)

Japanese Patent Publication No. 2103-68 discloses alkylphenylether sulfates having the following formula (B)

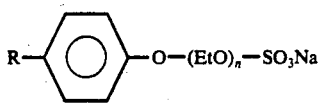

(B)

Japanese Patent Publication No. 24786-68 discloses sodium alkanesulfonates having the following formula (C)

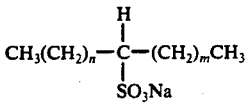

(C)

Since waste waters from domestic cleaning generally find their way into streams and rivers, it is desirable that surface active agents have a high biodegradability. On the other hand, domestic cleaning water is usually city water or well water containing calcium ions ($Ca^{++}$) and magnesium ions ($Mg^{++}$). If a surface active agent has a poor hard water resistance, it is converted into metal salts of these metals, thereby lowering drastically its properties as a surface active agent.

In light of these factors, the above-mentioned agent (A) essentially has poor detergency and poor foaming properties. Although the agent (B) has good resistance against hard water, it contains, as the alkylphenyl moiety in the principal commercially available materials, octylphenyl, nonylphenyl or dodecylphenyl groups and as a consequence, it has poor biodegradability. Finally, the agent (C) has poor resistance against hard water and, in order to blend it stably at a low temperature, it must substantially be used conjointly with a solubilizing agent.

SUMMARY OF THE INVENTION

We have discovered that sulfates of β-alkyl-substituted primary alcohols having the following formula (1) are surface active agents which dissolve in aqueous solutions of an alkli metal hypochlorite, they can be compounded therewith relatively stably, they cause little decomposition of the alkali metal hypochlorite and, moreover, they have excellent biodegradability as well as excellent hard water resistance;

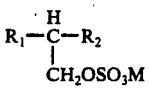

(1)

wherein $R_1$ and $R_2$ are alkyls having one to 13 carbon atoms, with the proviso that the total number of carbon atoms of $R_1$ plus $R_2$ is from 8 to 14; and M is Li, Na or K.

The surface active agents expressed by the above-mentioned formula (1) are known surface active agents generally referred to as synthetic alcohol sulfates. They can be prepared by carbonylation (oxo reaction) of Ziegler olefins or cracking olefins, hydrogen-reducing the resulting product, sulfating the resulting alcohol in a conventional manner and then neutralizing the same with an alkali metal hydroxide.

The synthetic alcohol sulfate thus prepared is obtained as a mixture of normal alcohol sulfates ($RO-SO_2M$, wherein R is straight-chain alkyl having 8 to 16 carbons) and the surface active agents having the formula (1). Accordingly, the surface active agent of the formula (1) is obtained by separating it at the stage of the synthetic alcohol in the above-mentioned production procedure. The surface active agent of the formula (1) thus obtained contains mostly a methyl group as one of $R_1$ and $R_2$. Generally, the surface active agent obtained has a wide distribution of alkyl groups in the other of $R_1$ and $R_2$.

When the alkyl in the other of $R_1$ and $R_2$ is short, however, the surface activity is low and lower alcohols tend to admix as unreacted products, thereby causing an offensive odor which makes the product unsuitable for home use. It is therefore desirable that the total number of the carbon atoms of $R_1$ and $R_2$ be at least 8. When the alkyl group is too long, on the other hand, the surface active agent having such a long alkyl group does not dissolve in an aqueous solution of an alkali metal hypochlorite but rather tends to precipitate. Accordingly, the total number of the carbon atoms of $R_1$ plus $R_2$ is preferably not greater than 14.

Of the surface active agents of formula (1), those having a total number of carbon atoms of $R_1$ and $R_2$ in a range of 8 to 10 have good solubility in aqueous solutions of an alkali metal hypochlorite and at the same time, they act as a so-called solubilizing agent effective to dissolve other surface active agents in the aqueous alkali metal hypochlorite solution, in addition to the action thereof as a surface active agent per se.

Those agents of formula (1) having 11 to 14 carbon atoms as the total number of carbon atoms of $R_1$ plus $R_2$ have poor solubility and therefore it is necessary to add another solubilizing agent (such as, for example, alkylbenzene sulfonates in which the alkyl has 3 to 8 carbon atoms, fatty acid soaps of 6 to 8 carbon atoms, sodium alkylbenzene carboxylate, etc.). In this case, however, the amount of the solubilizing agent required is less in comparison with the amount of solubilizing agents required to solubilize normal alcohol sulfate having the same number of carbon atoms.

In practicing the present invention, it is advantageous to use a mixture of synthetic alcohol sulfates having proper carbon atom distributions. The synthetic alcohols can be obtained as a mixture of normal alcohols and iso-alcohols (formula (1)) having a certain carbon chain length distribution. In the synthetic alcohol system principally containing 10 to 16 carbon atoms in total, therefore, iso-alcohol sulfates having a total number of carbon atoms of 10 to 12 act as solubilizing and surface active agents, so that the iso-alcohol sulfates having a total number of carbon atoms of 13 to 16 and normal alcohol sulfates having a total number of carbon atoms of 10 to 12 are dissolved in the aqueous alkali metal hypochlorite solution by means of iso-alcohol sulfates having a total number of carbon atoms of 10 to 12.

The synthetic alcohol sulfate mixture of the present invention preferably consists of (a) 40 to 100 wt.% of alcohol sulfates with a total number of carbon atoms of 10 to 12 and (b) the balance, i.e., 60 to 0 wt.%, of alcohol sulfates with a total number of carbon atoms of 13 to 16, wherein (1) 0 to 50 wt.% of (a) plus (b) consists of normal alcohol sulfates ($ROSO_3M$) and (2) the balance, i.e. 100 to 50 wt.%, consists of iso-alcohol sulfate (formula (1)).

In the liquid cleaning and bleaching composition of the present invention, the content of the surface active agent of formula (1), or mixture of the formula (1) agent and the normal alcohol sulfate, is in the range of 0.5 to 8% by weight, and, preferably is in the range of 1 to 6% by weight.

As the aqueous alkali metal hypochlorite solutions, the lithium salt and the potassium salt can be used in addition to the sodium salt. However, the use of the sodium salt is most common. The concentration of the alkali metal hypochlorite in the aqueous solution is in the range of 3 to 7% by weight and, preferably, in the range of 4 to 6% by weight. If the concentration is too high, problems tend to occur relating to the solubility of the surface active agent and a reduction in the available chlorine during storage for an extended period of time.

It is conventional to have an equimolar amount of sodium chloride copresent with sodium hypochlorite in the aqueous solution of the latter. When the surface active agent of formula (1) is added, however, it is advantageous to use an aqueous solution of sodium hypochlorite having a smaller sodium chloride content.

In the composition in accordance with the present invention, an alkali agent such as sodium hydroxide, sodium carbonate, sodium orthophosphate, etc., is added to the aqueous solution of the sodium hypochlorite as a stablizer in an amount of 0.05 to 2% by weight and, preferably, 0.1 to 1% by weight.

The present invention will be explained more specifically with reference to the following illustrative Examples wherein all percentages represent "% by weight."

EXAMPLE 1

| | |
|---|---|
| NaOCl | 12.0% |
| NaCl | 0.3% |
| NaOH | 2.0% |
| Water | balance |

Using an aqueous sodium hypochlorite solution (A) containing the above-mentioned components, the following blended compositions are prepared.

| | I (Control) | II (This Invention) | III (This Invention) |
|---|---|---|---|
| $n\text{-}C_{10}H_{22}OSO_3Na$ | 3% | — | 3% |
| $C_7H_{15}CH(CH_2OSO_3Na)-CH_3$ | — | 3% | 3% |
| Solution (A) | 50% | 50% | 50% |
| Water | 47% | 47% | 44% |

The composition I does not form a perfect solution at room temperature (20° C) but the composition II forms a perfect solution. The composition III also becomes perfectly transparent and clearly shows that isodecyl sulfate acts as a solubilizing agent for normal decyl sulfate.

EXAMPLE 2

The following mixture (B) is first prepared and consists of the surface active agent of the general formula $$R_1-CH(CH_2OSO_3Na)-CH_3$$

wherein $R_1$ has the following distribution:

| $R_1$ | |
|---|---|
| $C_7H_{15}$ | 50 % |
| $C_8H_{17}$ | 20 |
| $C_9H_{19}$ | 15 |
| $C_{10}H_{21}$ | 10 |
| $C_{11}H_{23}$ | 5 |

Using the same aqueous solution of sodium hypochlorite as used in Example 1, the following blended composition is prepared:

| | IV (This Invention) |
|---|---|
| Mixture (B) | 5 % |
| Solution (A) | 50 % |
| Water | 45 % |

In the same way, a mixture (C) is also prepared from normal alcohol sulfate having the same total number of carbon atoms and the same distribution. Using the mixture (C), a blend composition V (control) is prepared in the same way as composition IV.

The composition IV (invention) is transparent at room temperature, but the composition V (control) does not form a transparent solution.

Additionally, the composition IV (invention) does not cause precipitation of the surface active agent at a temperature of 5° C.

A 0.2% solution (in city water) is prepared from each composition and a foaming test is conducted for each solution by the Ross and Miles method. The results are tabulated below:

| | Amount of Foam | |
|---|---|---|
| | Immediately after test | After 5 min. |
| Composition IV | 135 mm | 110 mm |
| Composition V | 120 mm | 80 mm |

EXAMPLE 3

The following blended composition VI is prepared by the use of sulfate (D) which is obtained from a commercially available synthetic alcohol having a distribution of 46% of $C_{11}$- alcohol, 32% of $C_{13}$- alcohol and 22% of $C_{15}$- alcohol (average number of carbon atoms of 12.4) and having a normal alcohol content of 49% and an iso alcohol content of 51%.

| | Composition VI (This Invention) |
|---|---|
| Solution (A) | 40% |
| Sulfate (D) | 5% |
| Water | 55% |

The composition VI is transparent at room temperature. When it is stored at room temperature (20° C) for 3 months, the concentration of sodium hypochlorite is reduced to 4.50% from the initial concentration of 4.76%.

On the other hand, commercially available sodium hypochlorite was purchased. The concentration thereof is found to be 5.0%. Next, this sodium hypochlorite is diluted with water to a concentration of 4.80% and stored under the same conditions as mentioned above. At the end of 3 months, the concentration is reduced to 4.51%. This clearly shows that the addition of the surface active agent scarcely reduced the stability of the sodium hypochlorite, in comparison with a simple aqueous sodium hypochlorite solution.

The embodiments of the invention in which an exclusive property or privilege is claimed are defined as follows:

1. A liquid bleaching detergent composition, consisting essentially of an aqueous solution of:

from 3 to 7 weight percent of sodium, lithium or potassium hypochlorite;

from 0.5 to 8 weight percent of surfactant having the formula $$R_1-\underset{\underset{CH_2OSO_3M}{|}}{CH}-R_2$$

wherein $R_1$ and $R_2$ are alkyls having from one to 13 carbon atoms, with the proviso that the total number of carbon atoms of $R_1$ plus $R_2$ is from 8 to 14, and M is Li, Na or K;

and the balance is essentially water.

2. A composition as claimed in claim 1 in which the sum of $R_1$ plus $R_2$ is from 8 to 10.

3. A composition as claimed in claim 1 in which the sum of $R_1$ plus $R_2$ is from 11 to 14, and additionally containing a solubilizing agent selected from the group consisting of alkylbenzene sulfonates in which the alkyl has 3 to 8 carbons, water-soluble fatty acid soaps having 6 to 8 carbon atoms and water-soluble alkylbenzene carboxylate, the amount of said solubilizing agent being effective to dissolve said surfactant.

4. A composition as claimed in claim 1 in which the amount of said surfactant is from one to 6 weight percent, and said hypochlorite is sodium hypochlorite.

5. A composition as claimed in claim 4 in which the amount of said sodium hypochlorite is from 4 to 6 weight percent.

6. A composition as claimed in claim 5 in which one of $R_1$ and $R_2$ is methyl.

7. A liquid bleaching detergent composition, consisting essentially of an aqueous solution of:

from 3 to 7 weight percent of sodium, potassium or lithium hypochlorite;

from 0.5 to 8 weight percent of surfactant component consisting essentially of a. a first surfactant having the formula $$R_1-\underset{\underset{CH_2OSO_3M}{|}}{CH}-R_2$$

wherein $R_1$ and $R_2$ are alkyls having from one to 13 carbon atoms, with the proviso that the total number of carbon atoms of $R_1$ plus $R_2$ is from 8 to 14, and M is Li, Na or K;

b. a second surfactant having the formula $$ROSO_3M$$

wherein R is straight-chain alkyl having from 8 to 16 carbon atoms, and M has the same meaning as defined above said surfactant component containing from 50 to 100 weight percent of said first surfactant and the balance is said second surfactant;

and the balance is essentially water.

8. A liquid bleaching detergent composition as claimed in claim 7, in which said surfactant component contains from up to 60 weight percent of said first and second surfactants having a total number of carbon atoms of from 13 to 16, and the balance of said surfactant component is first and second surfactants having a total number of carbon atoms of from 10 to 12.

9. A composition as claimed in claim 7 in which the amount of said surfactant is from one to 6 weight percent and said hypochlorite is sodium hypochlorite.

10. A composition as claimed in claim 9 in which the amount of said sodium hypochlorite is from 4 to 6 weight percent.

11. A composition as claimed in claim 10 in which one of $R_1$ and $R_2$ is methyl.

* * * * *